US006784766B2

(12) United States Patent
Allison et al.

(10) Patent No.: US 6,784,766 B2
(45) Date of Patent: Aug. 31, 2004

(54) MEMS TUNABLE FILTERS

(75) Inventors: Robert C. Allison, Rancho Palos, CA (US); Jerold K. Rowland, Torrance, CA (US); Ron K. Nakahira, Buena Park, CA (US)

(73) Assignee: Raytheon Company, Waltham, MA (US)

( * ) Notice: Subject to any disclaimer, the term of this patent is extended or adjusted under 35 U.S.C. 154(b) by 44 days.

(21) Appl. No.: 10/224,985

(22) Filed: Aug. 21, 2002

(65) Prior Publication Data

US 2004/0036558 A1 Feb. 26, 2004

(51) Int. Cl.[7] ..... H01P 1/20
(52) U.S. Cl. ..... 333/205; 333/204; 333/24 C
(58) Field of Search ..... 333/205, 204, 333/125, 202, 207, 262, 24 C, 219

(56) References Cited

U.S. PATENT DOCUMENTS 5,578,976 A 11/1996 Yao
5,880,921 A 3/1999 Tham et al.
6,046,659 A 4/2000 Loo et al.
6,127,908 A 10/2000 Bozler et al.
6,275,122 B1 8/2001 Speidell et al.
6,331,257 B1 12/2001 Loo et al.
6,347,237 B1 2/2002 Eden et al.
6,404,304 B1 * 6/2002 Kwon et al. ..... 333/202
6,424,074 B2 * 7/2002 Nguyen ..... 310/309
6,492,883 B2 * 12/2002 Liang et al. ..... 333/132
6,535,722 B1 * 3/2003 Rosen et al. ..... 455/188.2
6,566,786 B2 * 5/2003 Nguyen ..... 310/309
6,639,491 B2 * 10/2003 Toncich ..... 333/125
2003/0132820 A1 * 7/2003 Shamsaifar et al. ..... 333/205

* cited by examiner

*Primary Examiner*—Brian Young
*Assistant Examiner*—John B. Nguyen
(74) *Attorney, Agent, or Firm*—Leonard A. Alkov

(57) ABSTRACT

A method for the design of tunable filters is disclosed. MEMS switches are used to alter the resonant frequency of one or more resonators. By tuning the resonant frequency of the resonators, the filter's characteristics also are tuned. Furthermore, MEMS switches are used to alter the input coupling, including direct input coupling and capacitive input coupling. Direct input coupling is altered by using the MEMS switches to select different input connection points. Capacitive input coupling is altered by using MEMS switches to add additional input capacitance to an input coupling capacitor.

34 Claims, 10 Drawing Sheets

MEMS TUNABLE FILTERS

FIELD OF THE INVENTION

The present invention relates to filters. More particularly, the invention relates to a method and apparatus using micro electro mechanical system (MEMS) technology for tuning a filter.

BACKGROUND OF THE INVENTION

Several types of filters are commonly used in electronic applications. These filters include, for example, high-pass filters, low-pass filters, band-pass filters, and band-stop filters. Each filter type provides a specific filtering function to meet a required performance characteristic.

The above-mentioned filters are well known in the art and will not be discussed in detail. Briefly, a high-pass filter has a passband from some frequency $\omega_p$ up upward, and a stopband from 0 to $\omega_5$ (where $\omega_s<\omega_p$). Conversely, a low-pass filter has a passband from 0 to $\omega_p$, and a stopband from $\omega_s$ upward (where $\omega_p<\omega_s$).

Band-pass and band-stop filters are similar to high-pass and low-pass filters, but include additional cutoff frequencies to accommodate the added filtering criteria. For example, a band-pass filter has a passband from $\omega_{p1}$ to $\omega_{p2}$, and a stopband from 0 to $\omega_{s1}$ and $\omega_{s2}$ upward (where $\omega_{s1}<\omega_{p1}<\omega_{p2}<\omega_{s2}$). Conversely, a band-stop filter has a passband from 0 to $\omega_{p1}$ and from $\omega_{p2}$ upward, and a stopband from $\omega_{s1}$ to $\omega_{s2}$ (where $\omega_{p1}<\omega_{s1}<\omega_{s2}<\omega_{p2}$).

The need for a high-quality factor (Q), low insertion loss tunable filter pervades a wide range of microwave and RF applications, in both military, e.g., radar, communications and electronic intelligence (ELINT), and commercial fields such as in various communications applications, including cellular. For example, placing a sharply defined band-pass filter directly at the receiver antenna input will often eliminate various adverse effects resulting from strong interfering signals at frequencies near the desired signal frequency in such applications. Because of the location of the filter at the receiver antenna input, however, the insertion loss must be very low to not degrade the noise figure. In most filter technologies, achieving a low insertion loss requires a corresponding compromise in filter steepness or selectivity.

In many applications, particularly where frequency hopping is used, a receiver filter must be tunable to either select a desired frequency or to trap an interfering signal frequency. Thus, the insertion of a linear tunable filter between the receiver antenna and the first nonlinear element (typically a low-noise amplifier or mixer) in the receiver offers, providing that the insertion loss is very low, substantial advantages in a wide range of RF and microwave systems. For example, in radar systems, high amplitude interfering signals, either from "friendly" nearby sources, or from jammers, can desensitize receivers or intermodulate with high-amplitude clutter signal levels to give false target indications. In high-density signal environments, RADAR warning systems frequently become completely unusable.

Micro Electro-Mechanical Systems (MEMS) technology is currently implemented for the fabrication of narrow band-pass filters (high-Q filters) for various communication circuits (see U.S. Pat. No. 6,275,122 issued to Speidell et al.). These filters use the natural vibrational frequency of micro-resonators to transmit signals at very precise frequencies while attenuating signals and noise at other frequencies. A conventional MEMS band-pass filter device includes a semi-conductive resonator structure suspended over a conductive input structure, which is extended to a contact. By applying an alternating electrical signal on the input of the device, an image charge is formed on the resonator, attracting it and deflecting it downwards. If the alternating signal frequency is similar to the natural mechanical vibrational frequency of the resonator, the resonator may vibrate, enhancing the image charge and increasing the transmitted AC signal. The meshing of the electrical and mechanical vibrations selectively isolates and transmits desired frequencies for further signal amplification and manipulation.

Tuning the resonator frequency in the above described MEMS filter can be implemented by applying a DC bias voltage relative to the input contact, which will apply an internal stress to the resonator. Alternatively, a DC bias voltage can be applied relative to the output contact which will cause a current to flow through the resonator, thus increasing its temperature. Both types of bias change the modulus of elasticity of the resonator, resulting in a change of its fundamental natural vibrational frequency and therefore changing the filter characteristics.

A drawback to this approach of tuning the resonator frequency is that there are numerous variables that must be taken into consideration to determine the change in resonator frequency. These variables include, for example, the actual current injected into the device, the actual temperature rise of the device due to the injected current, elasticity variations of the resonator, and the ambient temperature. A slight error, for example, in the calculation of the temperature rise or in the effect of the ambient temperature may result in an error in the tuning frequency and thus less than optimal performance of the filter.

Tunable filters also have been implemented using a micro electro mechanical (MEMS) variable capacitor, wherein the capacitance is altered by changing the distance between the capacitor plates. In the simple vertical motion, parallel plate form of this device, a thin layer of dielectric separating normal metal plates (or a normal metal plate from very heavily doped silicon) is etched out in processing to leave a very narrow gap between the plates. The thin top plate is suspended on four highly compliant thin beams which terminate on posts (regions under which the spacer dielectric has not been removed). When a DC tuning voltage is applied between the plates, the small electrostatic attractive force, due to the high compliance of the support beams, causes substantial deflection of the movable plate toward the fixed plate or substrate, thus increasing the capacitance.

While the conventional MEMS variable capacitor structure is capable of improved Q values and avoids intermodulation problems of "tunable materials", it has some potential problems. Because only the relatively weak electrostatic attraction between plates is used to drive the plate motion to vary the capacitance, the plate support "spider" structure must be extremely compliant to allow adequate motion with supportable values of bias voltage. A highly compliant suspension of even a small plate mass may render the device subject to microphonics problems (showing up as fluctuations in capacitance induced by mechanical vibrations or environmental noise). Having the electric field which drives the plates directly in the signal dielectric gap may cause another problem. In order to achieve a high tuning range (in this case, the ratio of the capacitance with maximum DC bias applied to that with no DC bias), the ratio of the minimum plate separation to the zero-bias plate separation must be large (e.g., 10 times would be desirable). Unfortunately, the minimum gap between the plates (maximum capacitance, and correspondingly, maximum danger of breakdown or "flash-over" failure between the plates) is achieved under exactly the wrong bias conditions: when the DC bias voltage is at a maximum.

Some of the deficiencies of the MEMS variable capacitor described above have been addressed in U.S. Pat. No. 6,347,237. In particular, plate separation control has been improved by the addition of an independent mechanical actuator. Plate motion is provided by a mechanical driver, such as a piezoelectric device, which is coupled to one of the capacitor plates. A tuning signal is connected to the mechanical driver to provide control signals for controlling the plate separation. The mechanical driver eliminates the problems associated with microphonics and other external disturbances and thus, control of plate separation is much more precise.

While the mechanically driven MEMS variable capacitor provides extremely high Q values and increased immunity to external disturbances, these improvements come with a price. In particular, the piezoelectric material required for the mechanical driver is relatively large, having a length of approximately 5 mm. This length may be reduced to approximately 3 mm through folding of the piezoelectric material. The overall length, however, is significantly large when compared to other integrated components. Furthermore, the mechanical driver requires precision mechanical fabrication and assembly, thus adding cost and time to the manufacturing process.

Accordingly, there is a need in the art for a tunable filter that is compact in size. Additionally, it would be advantageous to provide such a filter with accurate and repeatable cutoff frequencies and low insertion losses. It would also be advantageous to provide such a filter that is easily manufactured.

SUMMARY OF THE INVENTION

In the light of the foregoing, one aspect of the invention relates to an integrated circuit tunable filter, which includes a substrate, an input line on the substrate, an output line on the substrate, a plurality of tuning stubs on the substrate and a plurality of resonators on the substrate. At least one resonator is operatively coupled to the input line and at least one resonator is operatively coupled to the output line, and the plurality of resonators include at least one MEMS switch, wherein the at least one MEMS switch connects and disconnects the resonator to at least one of the plurality of tuning stubs to adjust the center frequency of the tunable filter.

A second aspect of the invention relates to an integrated circuit tunable band-pass filter, which includes a substrate, an input line on the substrate, an output line on the substrate, a plurality of interdigitated stripline resonators on the substrate and a plurality of switch-capacitor groups on the substrate. At least one interdigitated stripline resonator is connected to the input line and at least one interdigitated stripline resonator is connected to the output line. Each switch-capacitor group includes a capacitor connected in series to a micro electro mechanical system (MEMS) switch, and each MEMS switch includes a control signal to connect or disconnect the respective switch-capacitor group from one of the plurality of interdigitated stripline resonators.

A third aspect of the invention relates to an integrated circuit tunable band-stop filter, which includes a substrate, an input line on the substrate, an output line on the substrate, a transmission line on the substrate, a plurality of switch-capacitor groups on the substrate, and a plurality of transmission line resonators on the substrate. The transmission line is operatively coupled to the input line and the output line, and each switch-capacitor group includes a capacitor connected in series to a micro electro mechanical system (MEMS) switch, and each MEMS switch includes a control signal to connect or disconnect the respective switch-capacitor group from the transmission line. Each transmission line resonator is coupled to the transmission line through one of the plurality of switch-capacitor groups.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1A:
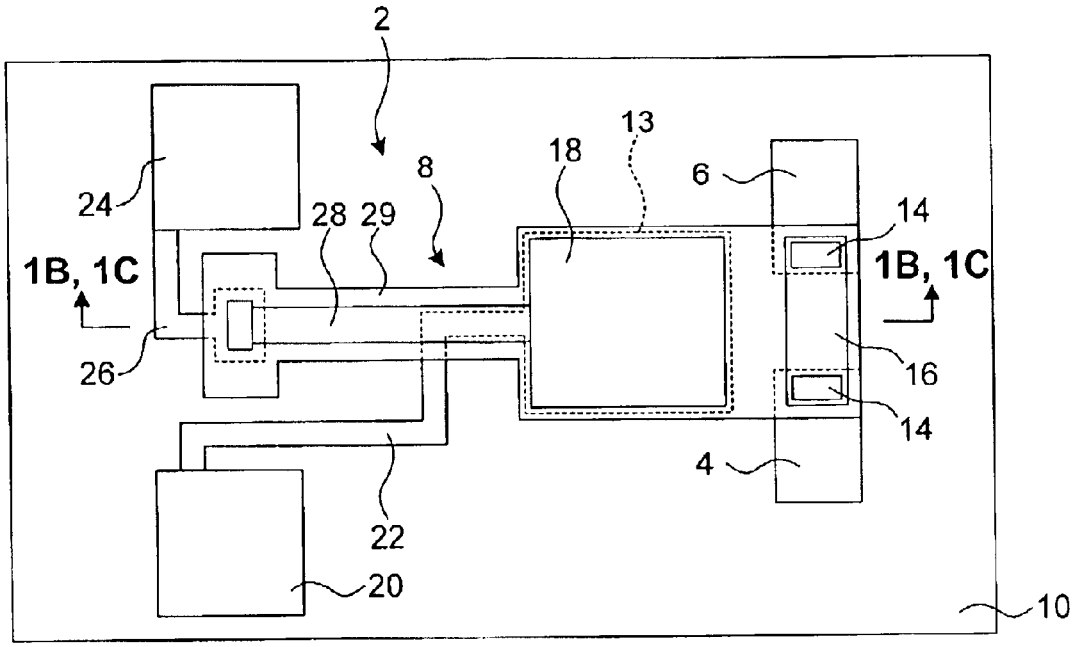
FIG. 1A is a block diagram of an exemplary MEMS switch that may be used in the present invention.

The following is a detailed description of the present invention with reference to the attached drawings, wherein like reference numerals will refer to like elements throughout.

A Micro Electro Mechanical System (MEMS) switch provides several advantages over a semiconductor switch (e.g., semiconductor transistors, pin diodes). In particular, a MEMS switch has a very low insertion loss (less than 0.2 dB at 45 GHz) and a high isolation when open (greater than 30 dB). In addition, the switch has a large frequency response and a large bandwidth compared to semiconductor transistors and pin diodes. These advantages provide enhanced performance and control when used in tunable filter designs.

Referring to FIG. 1A, a block diagram of a MEMS switch 2 that may be used in the present invention is illustrated. The MEMS switch 2 may be viewed as a single pole, single throw (SPST) switch device. In particular, the MEMS switch 2 may interrupt signal transmission by opening a conduction path between an input transmission line 4 and an output transmission line 6.

Figure 1B:
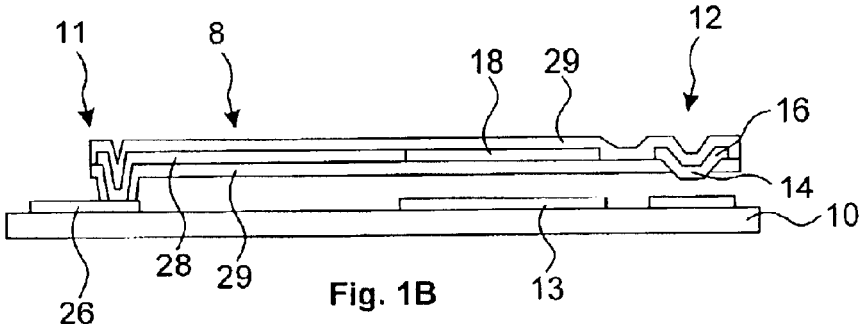
FIG. 1B is a cross section of the MEMS switch of FIG. 1A in an open position and taken along the line 1B—1B.
Figure 1C:
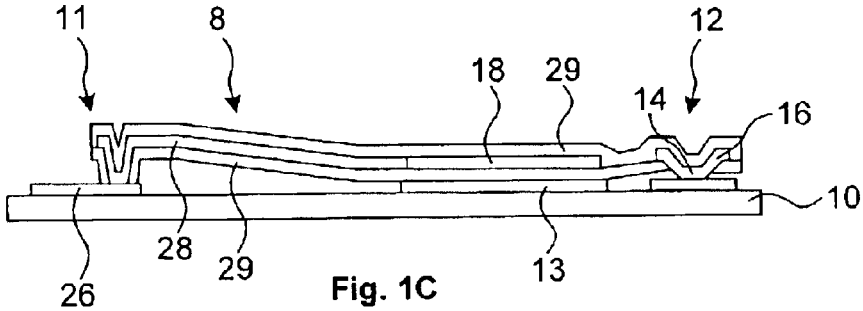
FIG. 1C is a cross section of the MEMS switch of FIG. 1A in a closed position and taken along the line 1C—1C.

Also referring to FIG. 1B (illustrating a cross-section of the MEMS switch 2 in an open position) and FIG. 1C (illustrating a cross-section of the MEMS switch 2 in a closed position), features and characteristics of the MEMS switch 2 will be described below. Briefly, the MEMS switch 2 is a metal-to-metal contact series switch that exhibits relatively low insertion loss and high isolation through microwave and millimeter wave frequencies. Additional details of a suitable switching unit can be found in U.S. Pat. No. 6,046,659, the disclosure of which is herein incorporated by reference in its entirety.

The MEMS switch 2 includes an armature 8 affixed to a substrate 10 at a proximal end 11 of the armature 8. A distal end (or contact end 12) of the armature 8 is positioned over an input transmission line 4 and an output transmission line 6. A substrate bias electrode 13 can be disposed on the substrate 10 under the armature 8 and, when the armature 8 is in the open position, the armature 8 is spaced from the substrate bias electrode 13 and the lines 4 and 6 by an air gap.

A pair of conducting dimples, or contacts 14, protrude downward from the contact end 12 of the armature 8 such that in the closed position, one contact 14 contacts the input line 4 and the other contact 14 contacts the output line 6. The contacts 14 are electrically connected by a conducting transmission line 16 so that when the armature 8 is in the closed position, the input line 4 and the output line 6 are electrically coupled to one another by a conduction path via the contacts 14 and conducting line 16. Signals can then pass from the input line 4 to the output line 6 (or vice versa) via the MEMS switch 2. When the armature 8 is in the open position, the input line 4 and the output line 6 are electrically isolated from one another.

Above the substrate bias electrode 13, the armature 8 is provided with an armature bias electrode 18. The substrate bias electrode 13 is electrically coupled to a substrate bias pad 20 via a conductive line 22. The armature bias electrode 18 is electrically coupled to an armature bias pad 24 via a conductive line 26 and armature conductor 28. When a suitable voltage potential is applied between the substrate bias pad 20 and the armature bias pad 24, the armature bias electrode 18 is attracted to the substrate bias electrode 13 to actuate the MEMS switch 2 from the open position (FIG. 1B) to the closed position (FIG. 1C).

The armature 8 can include structural members 29 for supporting components such as the contacts 14, conducting line 16, bias electrode 18 and conductor 28. It is noted that the contacts 14 and conductor 16 can be formed from the same layer of material or from different material layers. In the illustrated embodiment, the armature bias electrode 18 is nested between structural member 29 layers.

Figure 2:
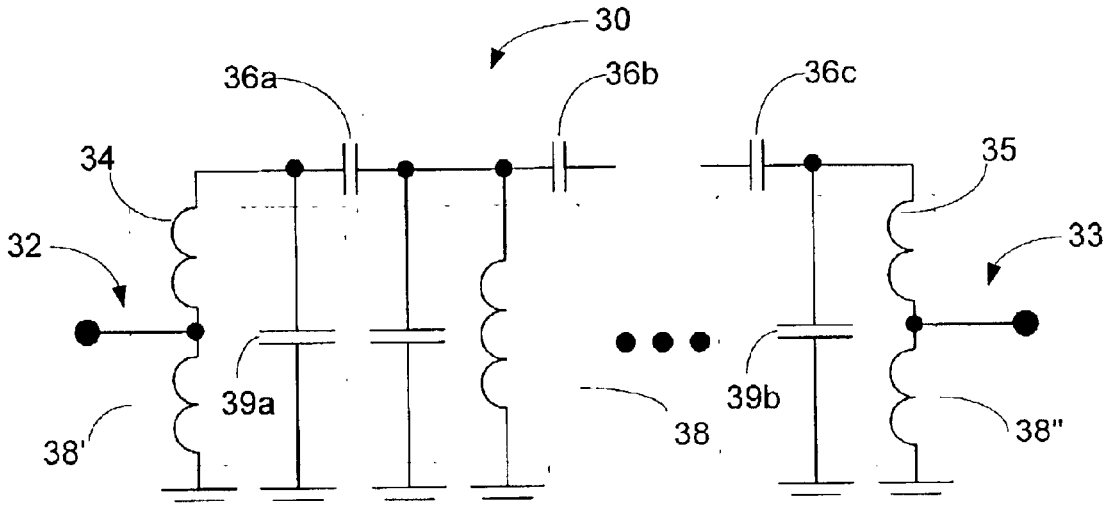
FIG. 2 is a simplified equivalent circuit for several conventional microstrip coupled line filter configurations.

Moving to FIG. 2, a simplified equivalent circuit 30 for various microstrip coupled line filter configurations is illustrated. A RF input connection 32 and a RF output connection 33 are coupled directly to an input inductor 34 and an output inductor 35 respectively. Coupling capacitors 36*a*, 36*b*, 36*c* provide AC coupling between the RF input connection 32 and the RF output connection 33. A first parallel resonant circuit 38 is connected between the first coupling capacitor 36*a* and the second coupling capacitor 36*b*. Input tuning capacitor 39*a* forms a second parallel resonant circuit 38' with the input inductor 34. Similarly, the output tuning capacitor 39*b* forms a third parallel resonant circuit 38" with the output inductor 35. Accordingly, the circuit 30 has three parallel resonant circuits, 38, 38', 38". The center frequency of the circuit 30 is determined from the resonant frequency of the three parallel resonant circuits 38, 38' 38". The center frequency of the circuit 30 may be changed, for example, by simultaneously tuning the three parallel resonant circuits. Furthermore, constant bandwidth may be preserved by tuning the coupling capacitance 36*a*, 36*b*, 36*c*, the RF input connection 32 and the RF output connection 33.

A first embodiment of the present invention provides a MEMS switched microstrip filter circuit which achieves tunable center frequencies while maintaining constant bandwidth. The tunable filter can be used for applications with signal frequencies up to at least 12 GHz, for example.

Figure 3:
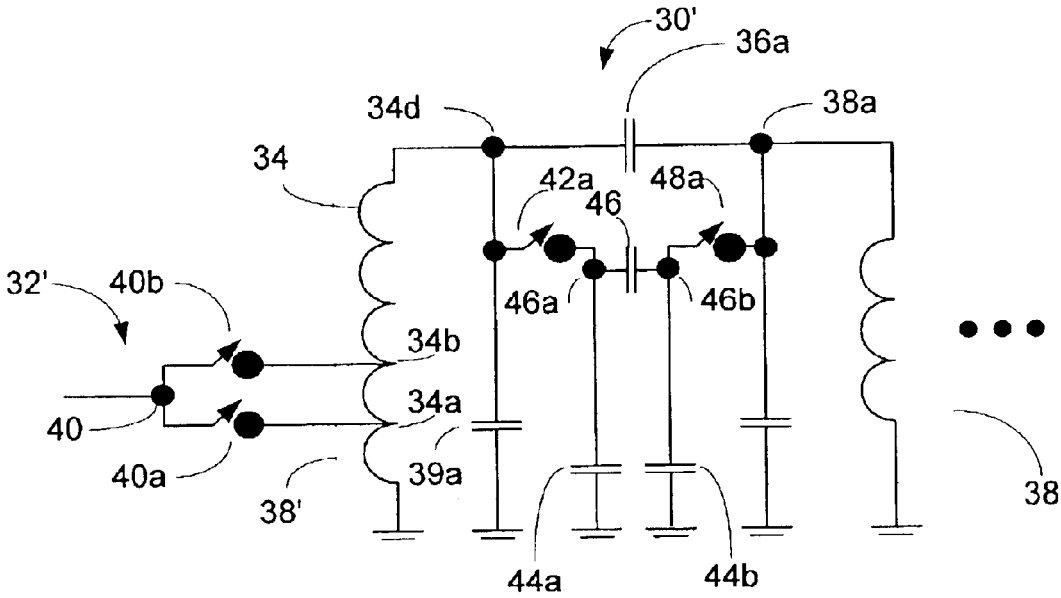
FIG. 3 illustrates a simplified equivalent circuit in relevant part of a two band switched tunable filter incorporating MEMS switches in accordance with one embodiment of the present invention.

Referring to FIG. 3, a simplified two band switched tunable filter 30' in accordance with the invention is illustrated, in relevant part. The switched tunable filter 30' incorporates MEMS switches to "tune" or alter the filter's characteristics. Tuning is implemented by changing the capacitance seen by the resonant circuits within the filter, thus changing their resonant frequency. For example, the capacitance seen by the resonant circuits may be changed using MEMS switches to connect and disconnect individual capacitors from the resonant circuits.

It is noted that control lines to command the each MEMS switch to "open" and "close" may or may not be shown in the diagrams. These control lines, however, would be evident to one skilled in the art.

In the tunable filter 30' illustrated in FIG. 3, a first input MEMS switch 40*a* and a second input MEMS switch 40*b* each have one end connected to node 40 of a RF input connection 32'. The first input MEMS switch 40*a* has its other end connected to an input inductor 34 at node 34*a*, and the second input MEMS switch 40*b* has its other end connected to the input inductor 34 at node 34*b*. The input inductor 34 is connected between node 34*d* and ground. A coupling capacitor 36*a* is connected between node 34*d* and node 38*a*. A first parallel resonant circuit 38 is connected between node 38*a* and ground, and an input tuning capacitor 39*a* is connected between node 34*d* and ground, thus forming a second parallel resonant circuit 38'. A first tuning MEMS switch 42*a* is connected between node 34*d* and node 46*a*. A first tuning capacitor 44*a* is connected between node 46*a* and ground, and a second tuning capacitor 44*b* is connected between node 46*b* and ground. A selectable coupling capacitor 46 is connected between node 46*a* and node 46*b*, and a second tuning MEMS switch 48*a* is connected between node 46*b* and node 38*a*.

The input MEMS switches 40*a*, 40*b* select between one of two possible input connections 32' on the input inductor 34, thus providing the ability to alter the input coupling. For example, when the first input MEMS switch 40*a* is closed and the second input MEMS switch 40*b* is open, the input inductance seen at the input connection 32' may be designated as L. Similarly, when the first input MEMS switch 40*a* is open and the second input MEMS switch 40*b* is closed, the input inductance may be designated as L', where L'>L. Thus, the inductance seen at the input connection 32' may be altered through the input MEMS switches 40*a*, 40*b*. In a similar manner, the output coupling (not shown) also may be adjusted using MEMS switches (not shown).

The capacitance of the circuit also may be altered using MEMS switches. For example, when the first tuning MEMS switch 42*a* and the second tuning MEMS switch 48*a* are closed, the first tuning capacitor 44*a* is connected in parallel to the second resonant circuit 38' and the second tuning capacitor 44*b* is connected in parallel to the first resonant circuit 38. In addition, the selectable coupling capacitor 46 is connected in parallel to the first coupling capacitor 36*a*. It is noted that the first and second tuning MEMS switches 42*a*, 48*a* are opened and closed together, thus tuning the first and second resonant circuits 38, 38' together.

Figure 4A:
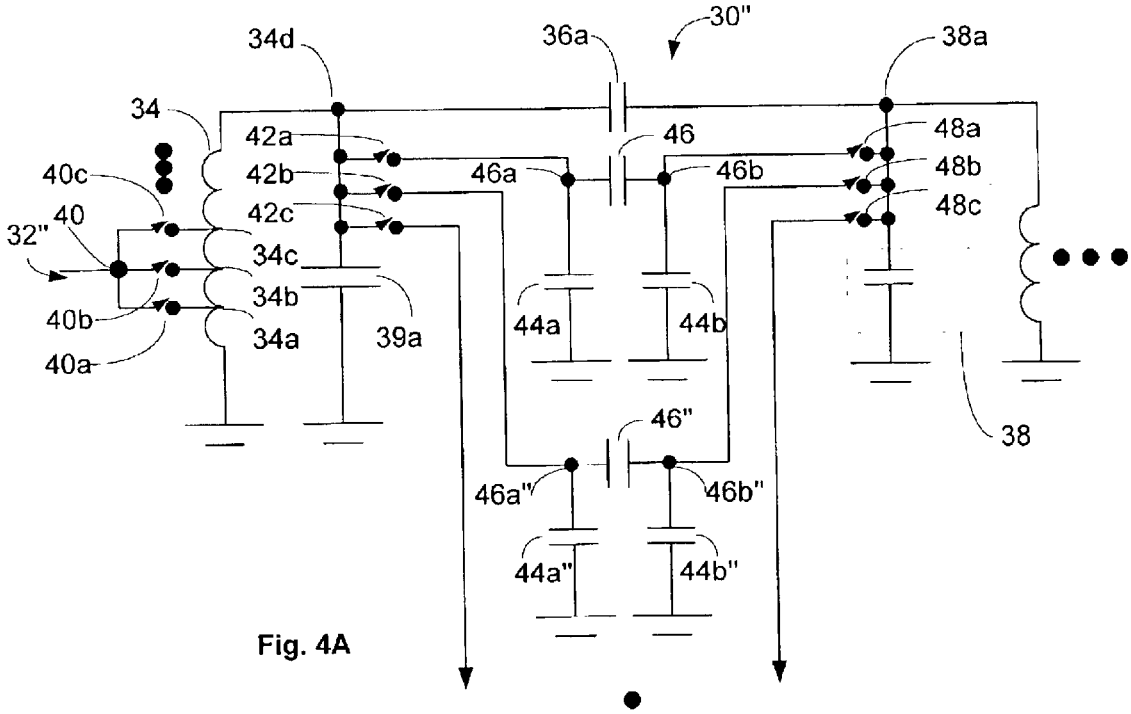
FIG. 4A illustrates a simplified equivalent circuit in relevant part of a multiple band switched tunable filter in accordance with another embodiment of the present invention.
Figure 4B:
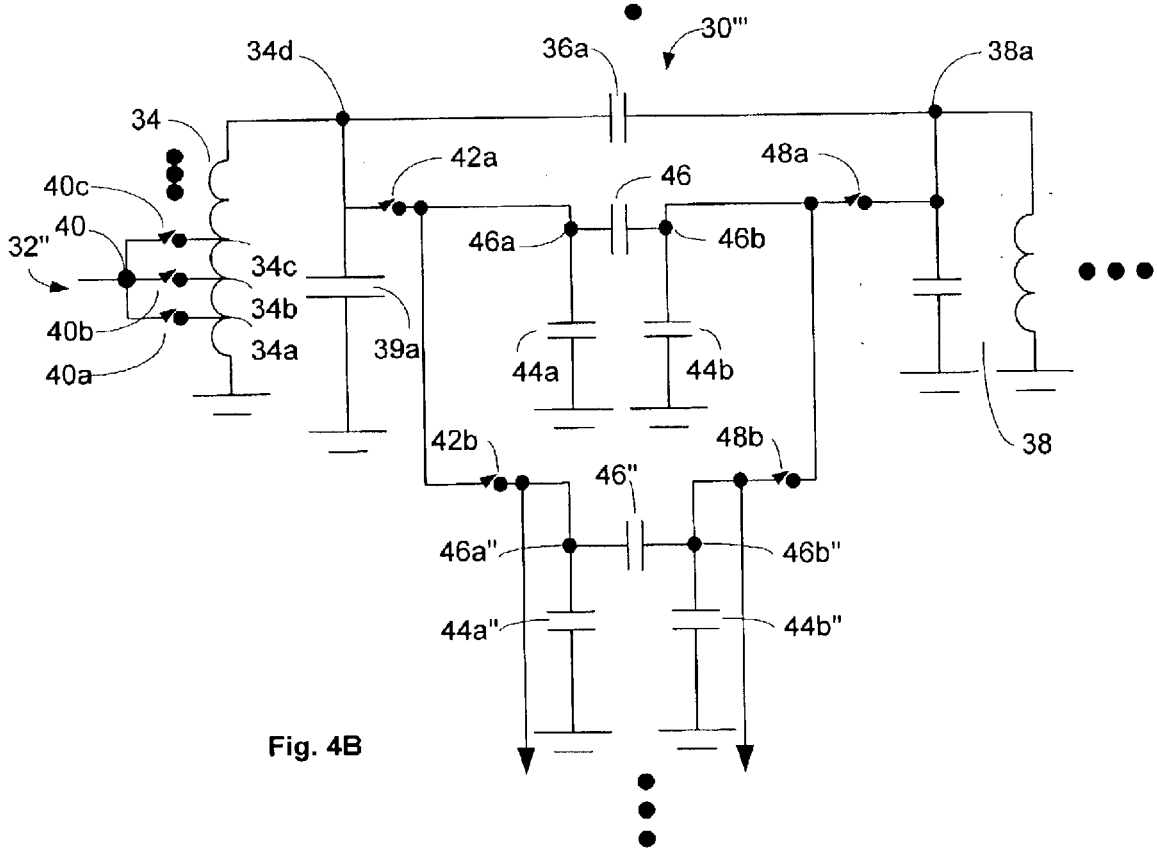
FIG. 4B illustrates a simplified equivalent circuit in relevant part of a multiple band switched tunable filter in accordance with another embodiment of the present invention.

FIG. 4A and FIG. 4B extend the concept shown in FIG. 3, and illustrate partial equivalent circuits with multiple band switching in accordance with the present invention. The switched tunable filter 30" of FIG. 4A is similar to the switched tunable filter 30' illustrated in FIG. 3 but includes additional tuning components which allow enhanced tuning of the tunable filter 30". For example, a third input MEMS switch 40*c* is connected between node 40 and node 34*c*. A third tuning MEMS switch 42*b* is connected between node 34*d* and node 46*a*". A fourth tuning MEMS switch 48*b* is connected between node 38*a* and node 46*b*". A fifth tuning MEMS switch 42*c* has one end connected to node 34*d* and the other end connected to a tuning network (not shown). The tuning network may be, for example, a capacitor network similar to the capacitor network formed by the first tuning capacitor 44*a*, the second tuning capacitor 44*b* and the selectable coupling capacitor 46 illustrated in FIG. 4A. A sixth tuning MEMS switch 48*c* has one end connected to node 38*a* and the other end connected to the tuning network (not shown). A third tuning capacitor 44*a*" is connected to node 46*a*" and ground, and a fourth tuning capacitor 44*b*" is connected between node 46*b*" and ground. A second selectable coupling capacitor 46" is connected between node 46*a*" and node 46*b*". It is noted that while FIG. 4A illustrates three input coupling connections and three separate tuning networks, this may be expanded to include any number of input coupling connections and tuning networks and FIG. 4A is not intended to be limiting in any way.

Operation of the switched tunable filter 30" is similar to the switched tunable filter 30' of FIG. 3. The switched tunable filter 30", in addition to the tuning selections available in FIG. 3, also offers additional tuning selections due to the additional MEMS switches. For example, the third input MEMS switch offers an additional input connection. Furthermore, the additional tuning MEMS switches 42*b*–42*c*, 48*b*–48*c* allow additional tuning capacitors 44*a*", 44*b*" and coupling capacitor 46" to be added to the tunable filter 30" as well as the additional tuning network (not shown). Moreover, numerous combinations can be achieved depending on the state of each tuning MEMS switch 42*a*–42*c*, 48*a*–48*c*, the input MEMS switches 40*a*–40*c* and the output MEMS switches (not shown). As is the case for the circuit 30' of FIG. 3, the MEMS switches are opened and closed in pairs, e.g., 42*b* and 48*b*, 42*c* and 48*c*.

The switched tunable filter 30'" of FIG. 4B is similar to the switched tunable filter 30" of FIG. 4A. The configuration of the tuning MEMS switches, however, is slightly different and provides a different result. In FIG. 4A, the first, third and fifth tuning MEMS switches 42*a*, 42*b*, 42*c* have one end connected to node 34*d*, and the second, fourth and sixth tuning MEMS switches 48*a*, 48*b*, 48*c* have one end connected to node 38*a*. In FIG. 4B, only the first tuning MEMS switch 42*a* has one end connected to node 34*d*, and only the second tuning MEMS switch 48*a* has one end connected to node 38*a*. The third tuning MEMS switch 42*b* is connected between node 46*a* and node 46*a*" and the fourth tuning MEMS switch is connected between node 46*b* and node 46*b*". The fifth tuning MEMS switch (not shown) has one end connected to node 46*a*" and the other end connected to the tuning network (e.g., the tuning networked described in FIG. 4A). The sixth tuning MEMS switch (not shown) has one end connected to node 46*b*" and the other end connected to the tuning network. The remainder of the switched tunable filter 30'" is essentially the same as the switched tunable filter 30" of FIG. 4A.

Operation of the filter 30'" of FIG. 4B differs from the operation of the filter 30" of FIG. 4A. In particular, each tuning MEMS switch in FIG. 4B requires the previous or "upstream" tuning MEMS switch to be closed before the "downstream" tuning MEMS switch may add capacitance to the tunable filter 30'". For example, in the tunable filter 30" of FIG. 4A, each tuning MEMS switch 42*a*–42*c*, 48*a*–48*c* may add capacitance to the circuit regardless of the state of the other tuning MEMS switches. This is due to the common connection point for each group of MEMS switches (e.g., node 34*d* for the first, third and fifth MEMS switches 42*a*, 42*b*, 42*c*, and node 38*a* for the second, fourth and sixth MEMS switches 48*a*, 48*b*, 48*c*). The tuning MEMS switches of the tunable filter 30'" of FIG. 4B, however, are connected in a serial configuration (e.g., the output of the first MEMS switch 42*a* is connected to the input of the third MEMS switch 42*b*, etc.). If the first tuning MEMS switch 42*a* is open, all components connected to the output of the MEMS switch 42*a* are disconnected from the tunable filter 30'". Thus, the third tuning MEMS switch 42*b* cannot add capacitance to the tunable filter until the first tuning MEMS switch 42*a* is closed. Similarly, the fifth tuning MEMS switch 42*c* cannot add capacitance to the tunable filter 30'" until both the first tuning MEMS switch 42*a* and the third tuning MEMS switch 42*b* are closed.

Figure 4C:
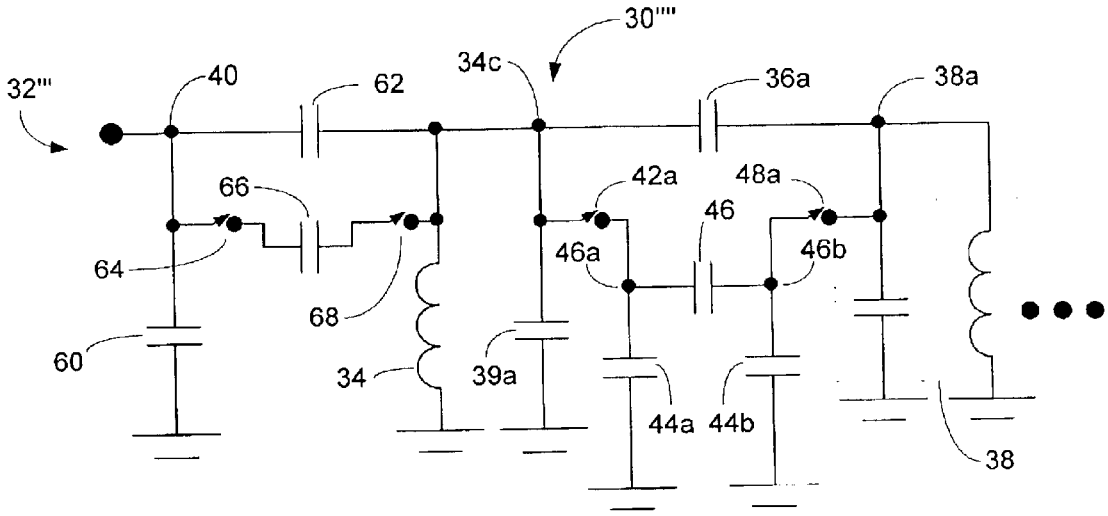
FIG. 4C illustrates selectable capacitive input coupling in accordance with another embodiment of the present invention.

Other types of filters, e.g., narrow bandwidth filters, may use capacitive input and output coupling, as is shown in the switched tunable filter 30"" of FIG. 4C. Variable capacitive input coupling can be achieved by a slight variation of the concept shown in FIG. 3. Referring to FIG. 4C, an input capacitor 60 is connected between node 40 and ground. A first coupling capacitor 62 is connected between node 40 of the RF input connection 32''' and node 34*c*. A first coupling MEMS switch 64 is connected to node 40 and to one end of a second coupling capacitor 66. A second coupling MEMS switch 68 is connected to node 34*c* and to the other end of the second coupling capacitor 66.

Initially, the coupling MEMS switches 64, 68 are open and the coupling capacitance seen at the RF input connection 32''' is determined by the capacitance of the first coupling capacitor 62. Additional coupling capacitance may be added by closing the coupling MEMS switches 64, 68. When the coupling MEMS switches 64, 68 are closed, the second coupling capacitor 66 is connected in parallel with the first coupling capacitor 62, thus increasing the coupling capacitance of the tunable filter 30''''. The same approach may be applied to the output coupling (not shown) of the tunable filter 30''''.

Figure 5:
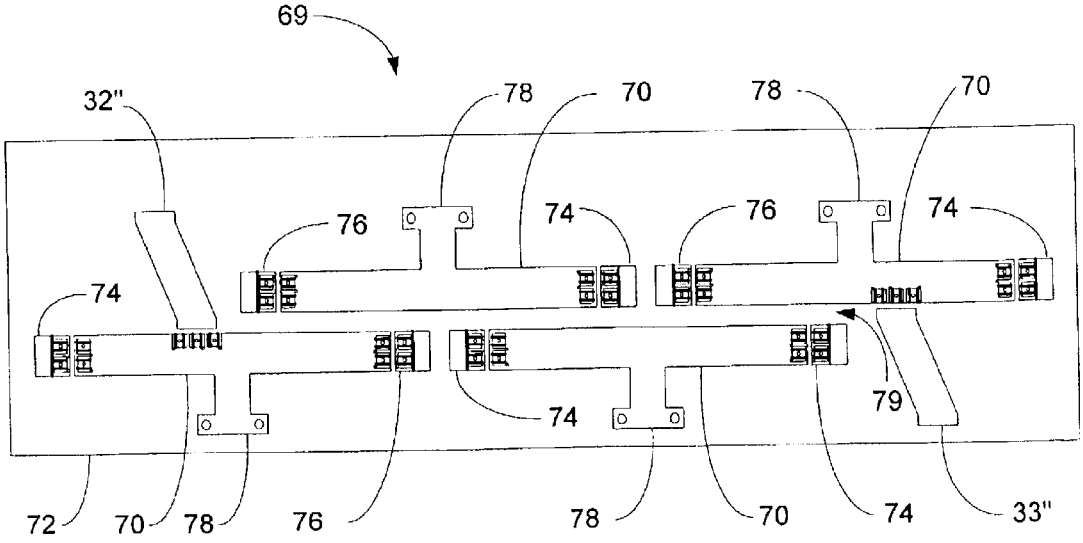
FIG. 5 is a strip line implementation of a switched tunable filter in accordance with an embodiment of the present invention.

A microstrip parallel coupled line implementation 69 of the tunable filter circuit 30''' of FIG. 4B is illustrated in FIG. 5. Input and output connections to the filter are made at the RF input connection 32'' and the RF output connection 33'' respectively. Microstrip resonators 70 are located on a substrate 72, and tuning stubs 74 are located at the ends of each resonator 70. Through MEMS switches 76, the tuning stubs 74 may be connected to the resonator 70. Each resonator 70 includes a ground connection 78 which is used for control signal input, as will be discussed later.

The resonator 70 may be a half wavelength transmission line resonator which will resonate at a resonant frequency $\omega_0$. As is well known by those skilled in the art, the resonant frequency of a transmission line resonator can be altered by changing the length of the transmission line resonator. The length of the resonator 70 can be increased by connecting the tuning stubs 74 to the end of the resonator 70 through MEMS switches 76. As the length of the resonator 70 is increased, the resonant frequency is decreased. The resonant frequency of the resonator 70 may be modeled using a parallel LC circuit. In a parallel LC circuit, the resonant frequency $\omega_0$ is determined from the formula $$\omega_0=1/\sqrt{(L*C)}$$

where L is the inductance and C is the capacitance. Accordingly, the resonant frequency of the parallel LC circuit may be altered by changing the inductance (L) or the capacitance (C) of the transmission line. Similarly, the resonant frequency of a transmission line resonator may be altered by changing the length of the transmission line, e.g., by adding length to the resonator 70 through the addition of tuning stubs 74.

As was discussed previously, the tuning stubs 74 can be added to the resonator 70 through the MEMS switches 76. The additional transmission line length reduces the resonant frequency of the resonator and thus permits tuning of the filter. Moreover, the tuning stubs 74 also increase the capacitive coupling 79 between adjacent resonators. The additional capacitive coupling enables constant bandwidth tuning. Referring to the circuits of FIG. 4B and FIG. 5, the increase in the transmission line length (through the connection of the tuning stubs 74 to the resonator 70) may be modeled as adding the tuning capacitors 44*a*, 44*b* (FIG. 4B) to the equivalent circuit 30'''. The increase in capacitive coupling 79 (FIG. 5) between adjacent resonators due to the lengthening of the resonator 70 (FIG. 5) may be modeled as adding the coupling capacitor 46 (FIG. 4B) to the equivalent circuit 30'''. Furthermore, the input and output coupling can be adjusted using MEMS switches to compensate for filter center frequency shift.

Figure 6A:
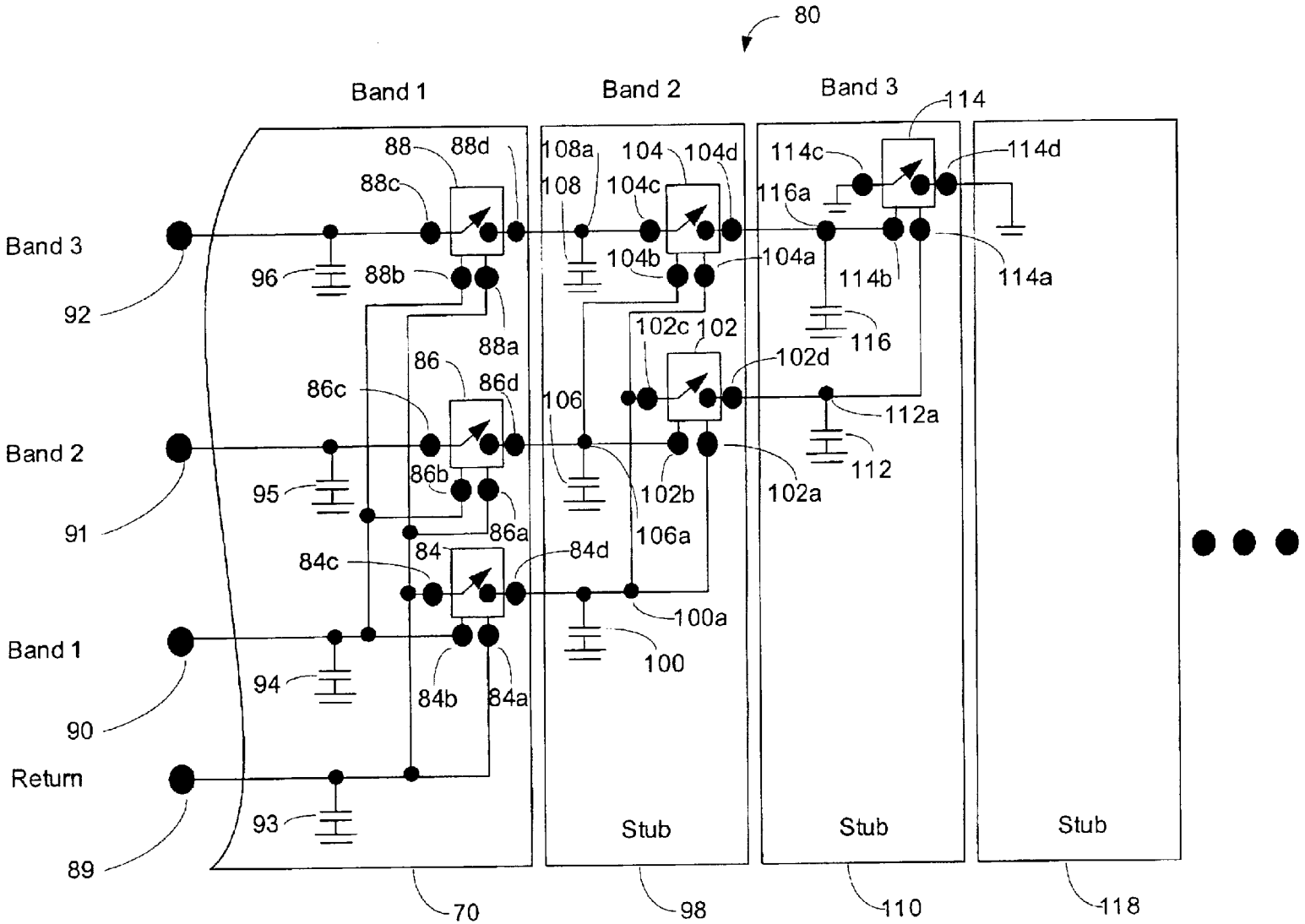
FIG. 6A illustrates a switched tunable filter in which MEMS switches provide RF connections to tuning stubs for filter tuning and paths for control signals for downstream MEMS switches in accordance with another embodiment of the present invention.

Referring now to FIG. 6A, a switch control scheme 80 for a tunable filter is illustrated. The switch control scheme 80 serially connects several stubs, one after the other, to the end of a resonator. Each successive stub, when selected through a MEMS switch, increases the length of the resonator, thus decreasing the resonant frequency of the resonator and increasing the capacitive coupling to the adjacent resonator. Furthermore, in addition to selecting stubs, each MEMS switch may provide a DC control signal to a downstream MEMS switch to command the switch to open or close. In short, each MEMS switch may provide a RF connection to tuning stubs for filter tuning and a path for a control signal to control a downstream MEMS switch.

The switch control scheme 80 of FIG. 6A will now be discussed in detail using a four band filter as an example. It is noted, however, that the filter may have any number of bands, and the present example is not intended to be limiting in any way. Three MEMS switches 84, 86, 88, are located on the end of the resonator 70, each MEMS switch having a 2-terminal control signal connection and a SPST (single pole single throw) switch contact. A first control terminal 84*a*, 86*a*, 88*a* of each MEMS switch is connected to node 89, which is referred to as the return path. A second control terminal 84*b*, 86*b*, 88*b* of each MEMS switch is connected to node 90, which is referred to as Band 1 selector. The band selector nodes 90, 91, 92 provide a signal to control the state of each bank of MEMS switches (e.g., open or close) on the resonator and each respective stub. The resonator ground connection 78 (FIG. 5) is connected to ground to provide a path to route the control signals out of the resonator 70 as will be discussed in more detail later. The resonator also includes four bypass capacitors 93, 94, 95, 96. The first bypass capacitor 93 is connected between node 89 and ground, the second bypass capacitor 94 is connected between node 90 and ground, the third bypass capacitor 95 is connected between node 91 and ground, and the fourth bypass capacitor 96 is connected between node 92 and ground.

The first MEMS switch 84 on the resonator 70 has a first terminal 84*c* connected to node 89, and a second terminal 84*d* connected to node 100*a* on an adjacent first stub 98.

The second MEMS switch 86 on the resonator 70 has a first terminal 86*c* connected to node 91 and a second terminal 86*d* connected to node 106*a* on the adjacent first stub 98.

The third MEMS switch 88 on the resonator 70 has a first terminal 88*c* connected to node 92 and a second terminal 88*d* connected to node 108*a* on the adjacent first stub 98.

The first stub 98 includes three bypass capacitors 100, 106, 108 and two MEMS switches 102, 104. The first bypass capacitor 100 is connected between node 100*a* and ground, the second bypass capacitor 106 is connected between node 106*a* and ground, and the third bypass capacitor 108 is connected between node 108*a* and ground. The first MEMS switch 102 on the first stub 98 has a first control terminal 102*a* connected to node 100*a*, and a second control terminal 102*b* connected to node 106*a*. The First MEMS switch also has a first terminal 102*c* which is connected to node 100*a*, and a second terminal 102*d* is connected to node 112*a* on an adjacent second stub 110. The second MEMS switch 104 on the first stub 98 has a first control terminal 104*a* connected to node 100*a* and a second control terminal 104*b* connected to node 106*a*. The second MEMS switch 104 also has a first terminal 104*c* which is connected to node 108*a*, and a second terminal 104*d* is connected to node 116*a* on the adjacent second stub 110.

The second stub 110 includes two bypass capacitors 112, 116 and one MEMS switch 114. The first bypass capacitor 112 on the second stub 110 is connected between node 112*a* and ground, and the second bypass capacitor 116 is connected between node 116*a* and ground. The MEMS switch 114 on the second stub 110 has a first control terminal 114*a* connected to node 112*a*, and a second control terminal 112*b* connected to node 116*a*. The MEMS switch also has a first terminal 114*c* connected to ground, and a second terminal 114*d* connected to ground on an adjacent third stub 118.

Figure 6B:
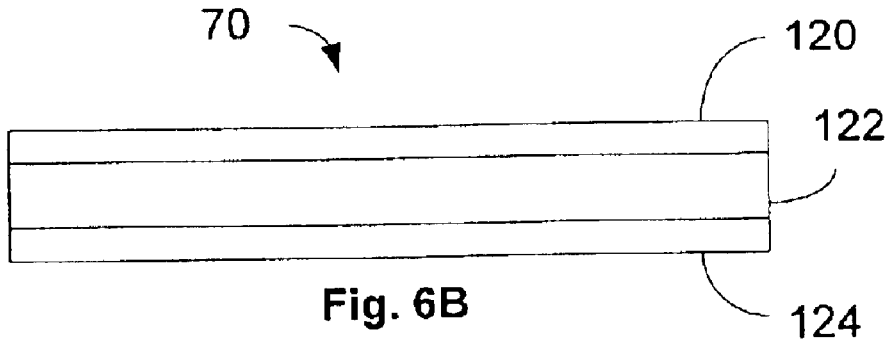
FIG. 6B is a partial side view of the strip line implementation of FIG. 5.

The operation of the circuit illustrated in FIG. 6A will now be discussed. Referring briefly to FIG. 6B, the microstrip resonator 70 is constructed from a metallization layer 120 on top of a dielectric substrate 122. The back side of the dielectric substrate 122 also includes a metallization layer 124. Thus, the two metallization layers 120,124 separated by a dielectric layer 122 form a transmission line. The three stubs 98, 110, 118 are constructed in the same manner illustrated in FIG. 6B and thus may be viewed as short transmission lines. By adding stubs to the resonator 70, the length of the resonator is increased and thus the resonant frequency of the resonator 70 is decreased.

Figure 6C:
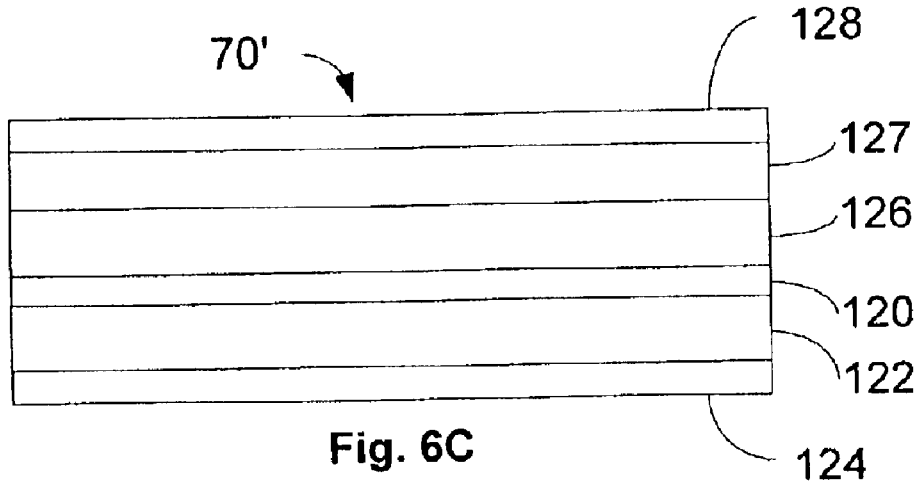
FIG. 6C is a partial side view of a strip line implementation illustrating the encapsulation of the control signal layer in accordance with an embodiment of the present invention.

To route control signals out of the MEMS switches, a multilayer substrate may be used, as illustrated in FIG. 6C. For example, the control conductors may be placed above the resonator metal 120 on an insulating layer 126. An additional insulation layer 127 and metal layer 128 may be applied above the control signal layer 126 to encapsulate the control signals to prevent them from interacting with the RF circuit.

Referring back to FIG. 6A, the band select signals 90, 91, 92 are assumed initially to be at logic 0 (low). Accordingly, all MEMS switches are in an open state and no additional stubs are added to the resonator 70. When Band 1 selector 90 is set to logic 1 (high), the control signal at each MEMS switch 84, 86, 88 on the resonator 70 is at logic 1 and the switches close. The Return connection 89, which is connected to the resonator ground and the Band select signals 2 and 3 are passed to the adjacent first stub 98 through the first, second and third MEMS switches 84, 86, 88 respectively. Furthermore, RF signals are passed through the same MEMS switches 84, 86, 88 and the bypass capacitors 93–96, 100, 106, 108. The bypass capacitors appear as short circuits to RF signals, and thus provide a means of connecting the resonator to stubs while isolating the control signals to the MEMS switches from the resonator and/or stubs. The length of the resonator 70 is increased through the connection to the adjacent first stub 98 (the metallization layer 120 of the resonator 70 is connected to the metallization layer (not shown) of the first stub 98). Accordingly, the resonant frequency of the resonator is decreased. Moreover, due to the increased resonator length, the capacitive coupling between adjacent resonators is increased. The increased capacitive coupling permits constant bandwidth of the filter throughout the tuning range Additional stubs may be added to the resonator 70 through Band 2 selector 91. For example, when Band 2 selector is set to logic 1, the control signal at the first and second MEMS switch 102, 104 on the first stub 98 is at logic 1 and the switches close. When the two switches 102, 104 are closed, the metallization layer (not shown) of the first stub 98 is connected to the metallization layer (not shown) of the second stub 110 which increases the length of the resonator 70. Accordingly, the resonant frequency of the resonator is decreased and the capacitive coupling between adjacent resonators is increased. Furthermore, Band 3 selector 92 is passed to the second stub 110 through the second MEMS switch 104.

In the same manner, the resonant frequency may be decreased again by setting the Band 3 selector 92 to logic 1, thus closing the MEMS switch 114 on the second stub 110. When the MEMS switch 114 is closed, the metallization layer (not shown) of the second stub 110 is connected to the metallization layer (not shown) of the third stub 118, which increases the length of the resonator 70. Accordingly, the resonant frequency of the resonator is decreased and the capacitive coupling between adjacent resonators is increased.

It is noted that in the present example if Band 2 selector 91 or Band 3 selector 92 is set to logic 1 while Band 1 selector 90 is set to logic 0, the length of the resonator 70 will not change. Band 2 and Band 3 signals are passed to the adjacent stubs only when the MEMS switches 84, 86, 88 on the resonator 70 are closed. Since the MEMS switches on the resonator 70 are controlled by the Band 1 selector 90, no signal will be passed to the adjacent stubs if Band 1 is at logic 0. Effectively, this configuration operates in the same manner as the tunable filter illustrated in FIG. 4B, which was discussed previously.

Figure 7:
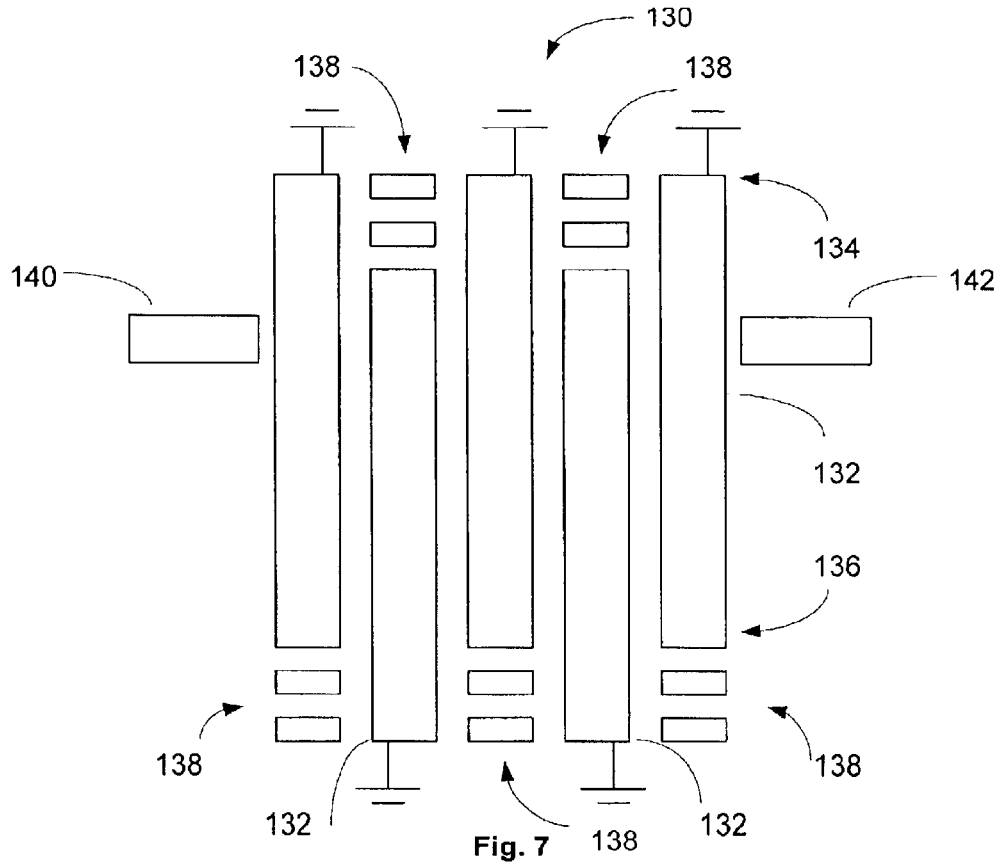
FIG. 7 illustrates a switched tunable filter implemented using an interdigitated structure in accordance with another embodiment of the presence invention.

In an alternative embodiment, the filter may be implemented using a microstrip interdigitated structure 130, as illustrated in FIG. 7. Resonators 132 are formed parallel to each other on a substrate (not shown). One end 134 of the resonator is grounded to provide a path to route the control signals out of the resonator. The other end 136 of the resonator has a plurality of MEMS switches (not shown) linking the resonator 132 to tuning stubs 138 to tune the frequency and bandwidth. A RF input connection 140 and a RF output connection 142 also may include MEMS switches to adjust the input and output coupling, including, for example, direct coupling and/or capacitive coupling, as was discussed previously.

Figure 8:
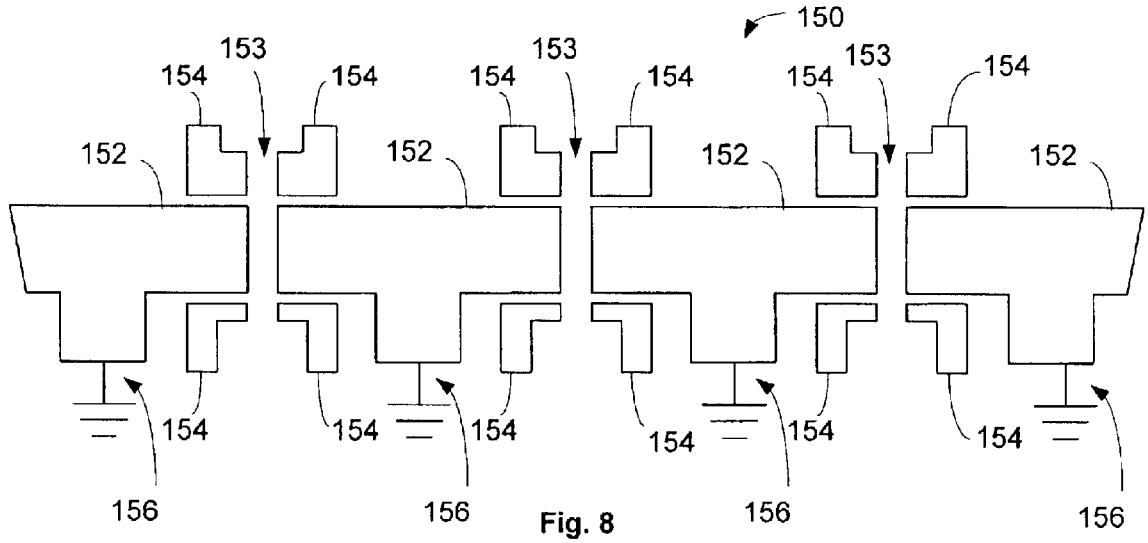
FIG. 8 illustrates a switched tunable filter implemented using a microstrip end coupled filter structure in accordance with an embodiment of the present invention.

Another embodiment includes a microstrip end coupled filter structure 150, as is illustrated in FIG. 8. Coupling between resonators 152 is accomplished by capacitive coupling 153 between the resonators. Tuning stubs 154 are selected by MEMS switches (not shown) and load the ends of the resonators 152, lowering the resonant frequency. Appropriate geometry of the stubs 154 provides the required additional coupling capacitance to achieve constant bandwidth. The geometry of the tuning stubs 154 may be determined using electromagnetic simulation software, which is well known by those skilled in the art. Using the electromagnetic simulation software, a structure is designed that adds the correct amount of capacitance to tune the resonator 152 to the desired frequency and at the same time increases the coupling capacitance 153 to the adjacent resonator to achieve the desired bandwidth. A resonator grounding section 156 is provided for bias input as was implemented in the parallel coupled line filter shown in FIG. 5. The stubs 154 can be selected individually or together via MEMS switches to select three bands.

Figure 9:
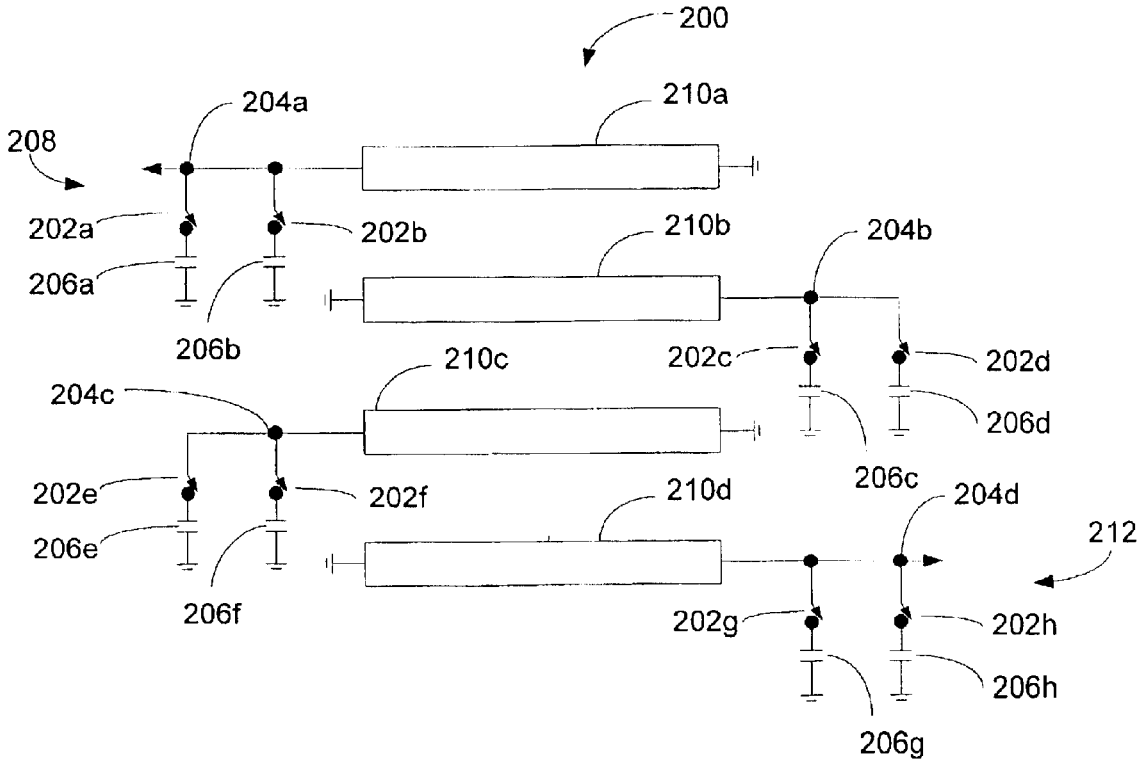
FIG. 9 illustrates an interdigitated switched tunable filter in accordance with an embodiment of the present invention.

Referring now to FIG. 9, a schematic diagram of a four-band switchable band-pass filter 200 is illustrated. The filter 200 is a four-section interdigitated stripline design. A first MEMS switch 202*a* has one end connected to node 204*a*. A first capacitor 206*a* has one end connected to the first MEMS switch 202*a* and the other end connected to ground. A second MEMS switch 202*b* has one end connected to node 204*a*. A second capacitor 206*b* has one end connected to the second MEMS switch 202*b* and the other end connected to ground. A RF input connection 208 is connected to node 204*a*, and a first resonator 210*a* has one end connected to node 204*a* and the other end connected to ground. A third MEMS switch 202*c* has one end connected to node 204*b*. A third capacitor 206*c* has one end connected to the third MEMS switch 202*c* and the other end connected to ground. A fourth MEMS switch 202*d* has one end connected to node 204*b*. A fourth capacitor 206*d* has one end connected to the fourth MEMS switch 202*d* and the other end connected to ground. A second resonator 210*b* has one end connected to node 204*b* and the other end connected to ground. A fifth MEMS switch 202*e* has one end connected to node 204*c*. A fifth capacitor 206*e* has one end connected to the fifth MEMS switch 202*e* and the other end connected to ground. A sixth MEMS switch 202*f* has one end connected to node 204*c*. A sixth capacitor 206*f* has one end connected to the sixth MEMS switch 202*f* and the other end connected to ground. A third resonator 210*c* has one end connected to node 204*c* and the other end connected to ground. A seventh MEMS switch 202*g* has one end connected to node 204*d*. A seventh capacitor 206*g* has one end connected to the seventh MEMS switch 202*g* and the other end connected to ground. An eighth MEMS switch 202*h* has one end connected to node 204*d*. An eighth capacitor 206*h* has one end connected to the eighth MEMS switch 202*h* and the other end connected to ground. A fourth resonator 210*d* has one end connected to node 204*d* and the other end connected to ground, and a RF output connection 212 is connected to node 204*d*.

The operation of the switched tunable bandpass filter 200 will now be described. Initially, all MEMS switches 202*a*–202*h* are assumed to be open. RF signals enter the filter 200 at the RF input connection 208. Signals which have a frequency substantially equivalent to the resonant frequency of the resonators 210*a*–210*h* pass through the filter, while signals with frequencies substantial different from the resonant frequency are rejected.

The pass band of the filter may be altered by changing the resonant frequency of the resonators. As was detailed previously, the resonator may be modeled as an LC circuit, and the resonant frequency of an LC circuit is determined from the inductance and capacitance of the resonant circuit ($\omega_0=1/\sqrt{(L*C)}$). Accordingly, by adding capacitance to the resonators 210*a*–210*h*, the resonant frequency may be altered and thus the pass band of the filter 200 may be controlled.

For example, closing the first MEMS switch 202*a* connects capacitor 206*a* to the first resonator 210*a*. The additional capacitance reduces the resonant frequency of the first resonator and thus the pass band of the filter 200. Similarly, capacitor 206*b* may be added to the first resonator 210*a* by closing MEMS switch 202*b*. By selectively enabling the capacitors 206*a*–206*h* through the MEMS switches 202*a*–202*h*, the pass band of the filter 200 may be precisely controlled. It is noted that as a particular capacitor is added to a resonator, a corresponding capacitor should be added to the remaining resonators. For example, if the first MEMS switch 202*a* is closed, thus adding the first capacitor 206*a* to first resonator 210*a*, then the third MEMS switch 202*c* should be closed to add the third capacitor 206*c* to the second resonator 210*b*; the fifth MEMS switch 202*e* should be closed to add the fifth capacitor 206*e* to the third resonator 210*c*; and the seventh MEMS switch 202*g* should be closed to add the seventh capacitor 206*g* to the fourth resonator 210*d*.

Figure 10:
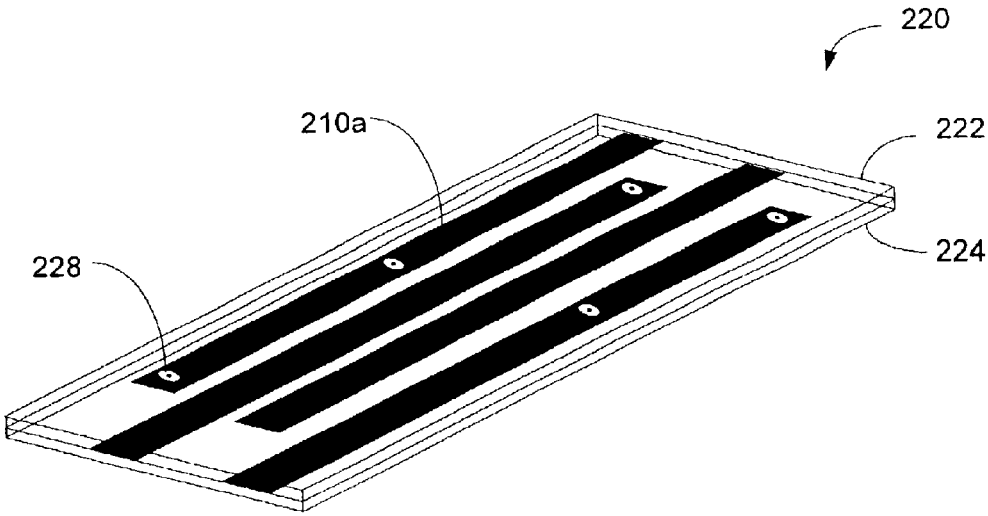
FIG. 10 is an interdigitated thick film substrate implementation of the circuit of FIG. 9 in accordance with the present invention.

FIG. 10 shows an illustration of the interdigitated thick film substrate 220. The substrate may be formed from a high-K dielectric ceramic material. The high-K dielectric material allows for a compact stripline design. In one embodiment, the dielectric ceramic material has a K of approximately 65. The conductors (not shown) are thick film etchable gold and two substrates 222, 224 are fired together using thick film dielectric paste to form the stripline. Connections between the resonators 210*a*–210*d* and the topside circuitry (not shown) are made through vias 228. The ceramic structure is externally metallized using thick film gold to provide the stripline ground.

Figure 11:
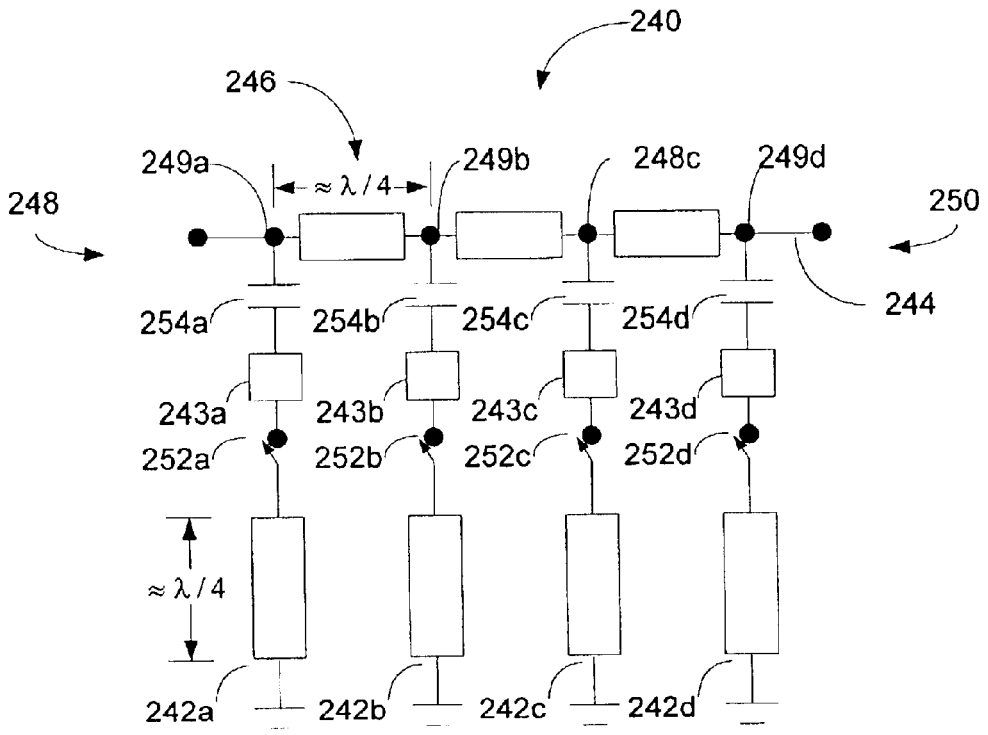
FIG. 11 illustrates a switched band-stop filter in accordance with an embodiment of the present invention.

A four section band-stop filter 240 is illustrated in FIG. 11. Quarter wavelength transmission line resonators 242*a*–242*d* are capacitively coupled to a transmission line 244 at approximately quarter wavelength intervals 246. The circuit provides a narrow stop band at the resonant frequency of the quarter wave resonators. The width of the stop band is determined by the amount of capacitive coupling between the resonators 242*a*–242*d* and the transmission line 244.

The band-stop filter 240 has a RF input connection 248 connected to node 249*a*. A first quarter wavelength resonator 242*a* has one end connected to a first MEMS switch 252*a* and the other end connected to ground. A first capacitor 254*a* has one end connected node 249*a* and its other end connected to the first MEMS switch 252*a*. Between the first capacitor 254*a* and the first MEMS switch 252*a* is a short section of transmission line 243*a*. A transmission line 244 is connected between node 249*a* and node 249*d*. In one embodiment the transmission line has an impedance of 50 ohms. A second quarter wavelength resonator 242*b* has one end connected to a second MEMS switch 252*b* and the other end connected to ground. A second capacitor 254*b* has one end connected node 249*b* and its other end connected to the second switch 252*b*. Between the second capacitor 254*b* and the second MEMS switch 252*b* is a short section of transmission line 243*b*. A third quarter wavelength resonator 242*c* has one end connected to a third MEMS switch 252*c* and the other end connected to ground. A third capacitor 254*c* has one end connected node 249*c* and its other end connected to the third MEMS switch 252*c*. Between the third capacitor 254*c* and the third MEMS switch 252*c* is a short section of transmission line 243*c*. A fourth quarter wavelength resonator 242*d* has one end connected to a fourth MEMS switch 252*d* and the other end connected to ground. A fourth capacitor 254*d* has one end connected node 249*d* and its other end connected to the fourth MEMS switch 252*d*. Between the fourth capacitor 254*d* and the fourth MEMS switch 252*d* is a short section of transmission line 243*d*. A RF output connection 256 is connected to node 249*d*.

As can be seen in FIG. 11, each MEMS switch 252*a*–252*d* is located part way between each coupling capacitor 254*a*–254*d* and the grounded end of each resonator. Due to its design, the MEMS switch inherently has a small amount of series capacitance while in the "open" state, which may cause a parasitic resonance when the MEMS switch is open. To reduce the effects of the parasitic resonance, each MEMS switch 252*a*–252*d* is positioned such that the parasitic resonant frequency, when the switch is open, is a frequency that is well above the band of interest. Locating the switch too far from the coupling capacitor places the MEMS switch in a low impedance area of the circuit and the switch loss becomes a significant factor. Furthermore, the rejection skirt widens out into the pass band area. In selecting the location of the MEMS switch, a trade off exists between moving the parasitic stop band far enough away from the band of interest and degrading performance of the filter due to switch loss. Electromagnetic simulation software may be used to determine the optimum location for each MEMS switch 252*a*–252*d*.

When all of the MEMS switches 252 are in the open state, the circuit provides a low loss thru-path for signals within the band of interest. Signals significantly above the band of interest, however, are prevented from passing through the filter 240 due to the parasitic resonance described previously. Since the parasitic resonance occurs above the band of interest, it does not present a problem for signals within the band of interest. When all of the MEMS switches 252*a*–252*d* are closed, a narrow stop band is formed at the resonant frequency of the resonator, thus preventing signals having a frequency within the stop band from passing through the filter 240. Multiple stop bands may be achieved by connecting multiple filters together in a cascade configuration, wherein each filter is designed for a different stop band. By selecting one or more cascaded filters, precise control of the stop band is achieved.

Figure 12:
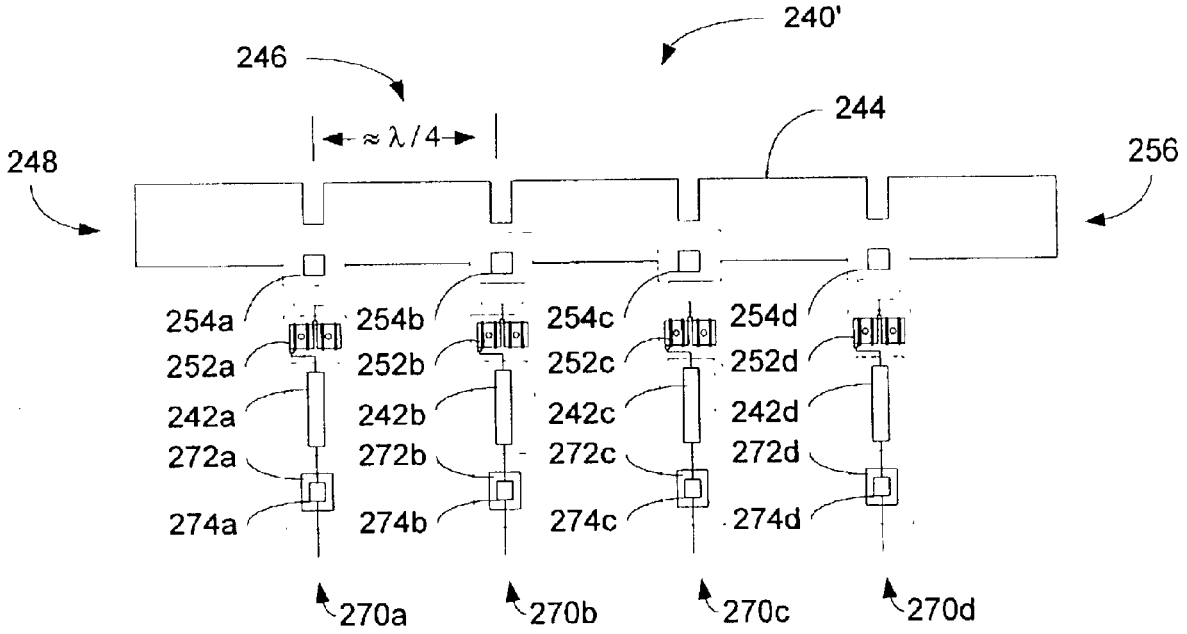
FIG. 12 is a microstrip implementation of the band-stop filter of FIG. 11.

The band-stop filter 240 may be implemented using a microstrip structure 240' as illustrated in FIG. 12. As was discussed above with regard to FIG. 11, the microstrip structure 240' includes a transmission line 244, wherein resonators 242*a*–242*d* are spaced along the transmission line 244 at quarter wavelength intervals 246. The resonators 242*a*–242*d* are coupled to a transmission line 244 through MEMS switches 252*a*–252*d* and coupling capacitors 254*a*–254*d* respectively. A RF input connection 248 and a RF output connection 256 provide signal input and output points to the filter 240'. In addition, control input terminals 270*a*–270*d* each feed control signals to each MEMS switch 252*a*–252*d*. The control signal provides the command to open or close each MEMS switch 252*a*–252*d*. Control input bypass capacitors 272*a*–272*d* short out any RF frequencies that may find their way into the control circuitry. Ground vias 274*a*–274*d* provide a ground connection to the resonators 242*a*–242*d*.

Figure 13:
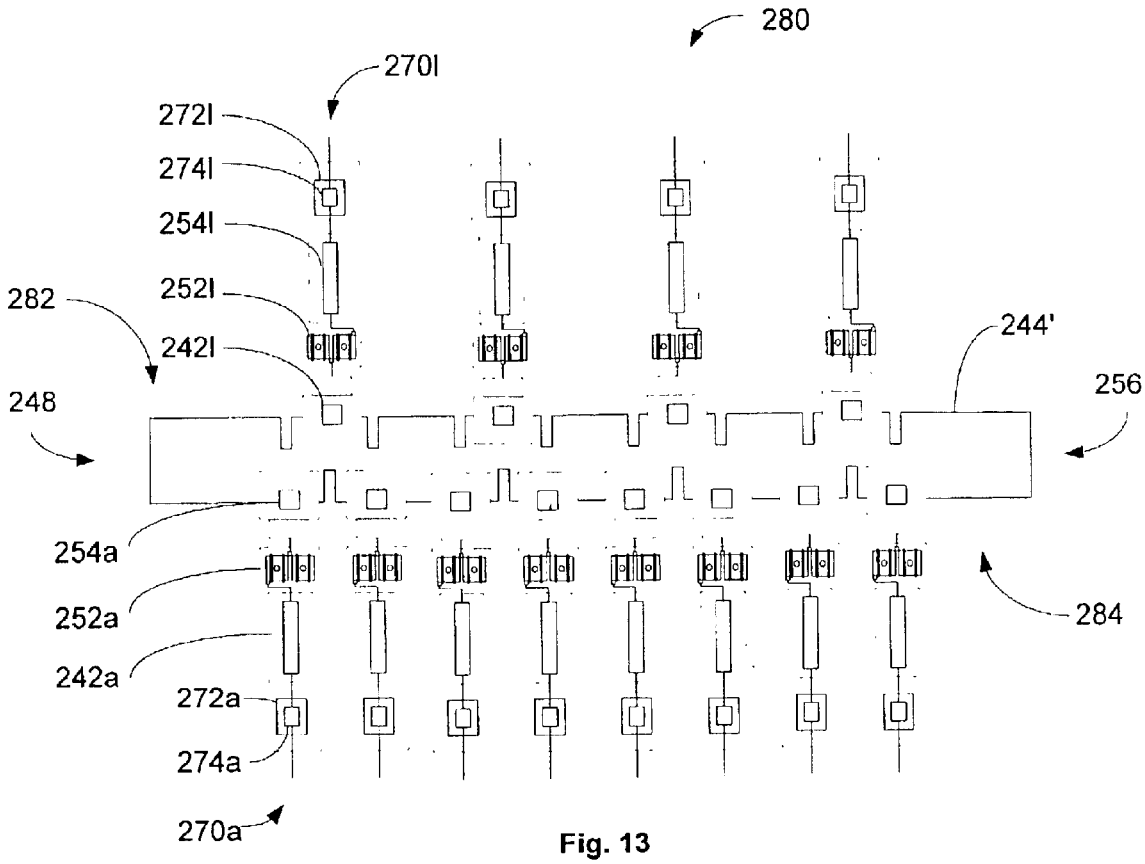
FIG. 13 illustrates a three band switched band-stop filter implemented using an interleaved structure in accordance with another embodiment of the present invention.

FIG. 13 illustrates an alternative embodiment of the band-stop filter. In particular, FIG. 13 illustrates a three stop band filter 280 implemented using an interleaved structure. The band-stop filter 280 includes a transmission line 244' and resonators 242*a*–242*l* coupled to the transmission line 244' through MEMS switches 252*a*–252*l* and coupling capacitors 254*a*–254*l*. The resonators are placed on both the top 282 and bottom 284 of the transmission line 244', thus allowing more resonators to be placed along the transmission 244'. An RF input connection 248 and a RF output connection 256 provide signal input and output points to the filter. Control input terminals 270*a*–270*l* feed control signals to each MEMS switch 252*a*–252*l* to command the respective switch to open or close, and ground vias 272*a*–272*l* provide a ground connection to each resonator 242*a*–242*l*.

While particular embodiments of the invention have been described in detail, it is understood that the invention is not limited correspondingly in scope, but includes all changes, modifications and equivalents coming within the spirit and terms of the claims appended hereto.

What is claimed is:

1. An integrated circuit tunable filter, comprising:

a substrate;

an input line on the substrate;

an output line on the substrate;

a plurality of tuning stubs on the substrate; and a plurality of resonators on the substrate, wherein at least one resonator is operatively coupled to the input line and at least one resonator is operatively coupled to the output line, and at least one MEMS switch connects and disconnects at least one of the plurality of resonators to at least one of the plurality of tuning stubs to adjust the center frequency of the tunable filter.

2. The integrated circuit tunable filter of claim 1, wherein at least one of the tuning stubs includes at least one MEMS switch.

3. The integrated circuit tunable filter of claim 2, wherein each MEMS switch includes a control signal to command the MEMS switch to open and close.

4. The integrated circuit tunable filter of claim 3, wherein the tuning stubs are connected serially to the resonator, one after the other, and downstream tuning stubs receive the control signal from an upstream MEMS switch.

5. The integrated circuit tunable filter of claim 3, wherein the resonator includes a grounding leg to provide a path to route the control signal.

6. The integrated circuit tunable filter of claim 1, wherein the resonator is a transmission line resonator.

7. The integrated circuit tunable filter of claim 1, further comprising direct input coupling and direct output coupling.

8. The integrated circuit tunable filter of claim 7, wherein the direct input coupling and the direct output coupling are adjustable.

9. The integrated circuit tunable filter of claim 8, wherein the direct input coupling and the direct output coupling are adjusted using a plurality of MEMS switches to select one of a plurality of different input connections and one of a plurality of different output connections.

10. The integrated circuit tunable filter of claim 1, further comprising capacitive input coupling and capacitive output coupling.

11. The integrated circuit tunable filter of claim 10, wherein the capacitive input coupling and the capacitive output coupling are adjustable.

12. The integrated circuit tunable filter of claim 11, wherein the capacitive input coupling and the capacitive output coupling are adjusted using a plurality of MEMS switches coupled to capacitors to add additional capacitance to the input coupling and the output coupling.

13. The integrated circuit tunable filter of claim 1, wherein the filter is implemented using a microstrip parallel coupled line structure.

14. The integrated circuit tunable filter of claim 1, wherein the filter is implemented using a microstrip interdigitated structure.

15. The integrated circuit tunable filter of claim 1, wherein the filter is implemented using a microstrip end coupled structure.

16. The integrated circuit tunable filter of claim 1, wherein the tuning stubs provide substantially constant bandwidth throughout a band of interest.

17. An integrated circuit tunable band-pass filter, comprising:

a substrate;

an input line on the substrate;

an output line on the substrate;

a plurality of interdigitated stripline resonators on the substrate, wherein at least one interdigitated stripline resonator is connected to the input line and at least one interdigitated stripline resonator is connected to the output line; and a plurality of switch-capacitor groups on the substrate, wherein each switch-capacitor group includes a capacitor connected in series to a micro electro mechanical system (MEMS) switch, and each MEMS switch connects or disconnect the respective capacitor from one of the plurality of interdigitated stripline resonators.

18. The integrated circuit tunable band-pass filter of claim 17, wherein the substrate further comprises two substrates fired together and a thick film dielectric paste is used to form the stripline resonators.

19. The integrated circuit tunable band-pass filter of claim 18, wherein the substrate is comprised of a High-K dielectric ceramic material.

20. The integrated circuit tunable band-pass filter of claim 19, wherein a dielectric constant of the dielectric ceramic material is approximately 65.

21. The integrated circuit tunable band-pass filter of claim 19, wherein the ceramic structure is externally metallized to provide a stripline ground.

22. The integrated circuit tunable band-pass filter of claim 21, wherein the ceramic structure is externally metallized using a thick film gold.

23. The integrated circuit tunable band-pass filter of claim 17, wherein the tuning stub geometry provides substantially constant bandwidth throughout a band of interest.

24. An integrated circuit tunable band-stop filter, comprising:

a substrate;

an input line on the substrate;

an output line on the substrate;

a transmission line on the substrate, wherein the transmission line is operatively coupled to the input line and the output line;

a plurality of switch-capacitor groups on the substrate, wherein each switch-capacitor group includes a capacitor connected in series to a micro electro mechanical system (MEMS) switch, and each MEMS switch connects or disconnects the respective capacitor from the transmission line; and a plurality of transmission line resonators on the substrate, wherein each transmission line resonator is coupled to the transmission line through one of the plurality of switch-capacitor groups.

25. The integrated tunable band-stop filter of claim 24, wherein the transmission line resonators are quarter wavelength resonators, and the resonators are spaced along the transmission line at quarter wavelength intervals.

26. The integrated circuit tunable band-stop filter of claim 25, wherein the transmission line resonators are interleaved.

27. The integrated circuit tunable band-stop filter of claim 25, wherein each MEMS switch is positioned between the resonator and the capacitor to place a parasitic resonant frequency substantially above a band of interest.

28. The integrated circuit tunable band-stop filter of claim 27, wherein the transmission line impedance is about 50 ohms.

29. The integrated circuit tunable filter of claim 25, further comprising capacitive input coupling and capacitive output coupling.

30. The integrated circuit tunable filter of claim 29, wherein the capacitive input coupling and the capacitive output coupling are adjustable.

31. The integrated circuit tunable filter of claim 30, wherein the capacitive input coupling and the capacitive output coupling are adjusted using a plurality of MEMS switches coupled to capacitors to add additional capacitance to the input coupling and the output coupling.

32. The integrated circuit tunable filter of claim 25, wherein the filter is implemented using a microstrip structure.

33. The integrated circuit tunable filter of claim 25, wherein each MEMS switch is positioned relative to the capacitor to reduce the effects of parasitic resonance and reduce the effects of switch loss.

34. An integrated circuit tunable filter, comprising:

a substrate;

an input line on the substrate;

an output line on the substrate;

a plurality of resonators on the substrate; and a plurality of micro electro mechanical system (MEMS) switches on the substrate, wherein at least one MEMS switch alters the resonant frequency of the resonators to change the filtering characteristics of the tunable filter.

* * * * *